US005180350A

United States Patent [19]

Thomas

[11] Patent Number: 5,180,350

[45] Date of Patent: Jan. 19, 1993

[54] EXERCISE BAR APPARATUS

[76] Inventor: David D. Thomas, 34 Lakeview Ave., Holbrook, Mass. 02343-1202

[21] Appl. No.: 657,406

[22] Filed: Feb. 19, 1991

[51] Int. Cl.[5] ..... A63J 1/00

[52] U.S. Cl. ..... 482/40; 482/38; 482/138

[58] Field of Search ..... 482/38, 39, 40, 106, 482/108, 109, 48, 49, 148

[56] References Cited

U.S. PATENT DOCUMENTS

| | | | |
|---|---|---|---|
| 814,570 | 3/1906 | Stockdell | 482/108 |
| 2,062,813 | 12/1936 | Knourek | 482/38 |
| 2,637,555 | 5/1953 | Klaudt | 482/40 |
| 3,525,521 | 8/1970 | Sylvester | 482/40 |
| 3,884,464 | 5/1975 | Evangelos | 482/49 X |
| 4,111,414 | 9/1978 | Roberts | 482/38 |
| 4,473,225 | 9/1984 | Miller | 482/40 |
| 4,529,191 | 7/1985 | Miller et al. | 482/40 |
| 4,844,448 | 7/1989 | Niznik | 482/40 |

FOREIGN PATENT DOCUMENTS

| | | | |
|---|---|---|---|
| 0376607 | 7/1932 | United Kingdom | 482/49 |

OTHER PUBLICATIONS

Our Gym Bars AMF Whitley 29 Essex St. Maywood N.J. 07607 DGB and DBG40 Gym Bars 1980.

*Primary Examiner*—Richard J. Apley
*Assistant Examiner*—Jerome Donnelly
*Attorney, Agent, or Firm*—Leon Gilden

[57] ABSTRACT

An exercise bar is rotatably mounted relative to a central support rod, the central rod including extension members extending coaxially and laterally of the bar for mounting within opposed vertical door frame portions. The bar includes an exterior shell rotatably mounted relative to an interior shell, wherein a modification of the invention includes a central rod portion of a first diameter less than that of spaced end portions to accommodate individuals of various sized hands for mounting onto the bar.

1 Claim, 4 Drawing Sheets

PRIOR ART

EXERCISE BAR APPARATUS

BACKGROUND OF THE INVENTION

1. Field of the Invention

The field of invention relates to exercise apparatus, and more particularly pertains to a new and improved exercise bar apparatus wherein the same is arranged for mounting within a door frame for permitting exercise of an individual.

2. Description of the Prior Art

Door frame supported apparatus is known in the prior art to accommodate various pull-up, chin-up, and the like maneuvers in exercising procedures. An example of such may be found in U.S. Pat. No. 4,529,191 to Miller wherein an exercise bar is arranged relative to a door frame utilizing support bracketry to permit the bar to receive opposed sides of the door frame therewithin.

U.S. Pat. No. 4,772,011 to Guridi sets forth an exercise apparatus wherein apertured frame members are mounted in opposed sides of a door frame structure.

U.S. Pat. No. 4,605,541 to Kirkpatrick sets forth an exercise door apparatus wherein the same utilizes an exercise bracket which is removably mounted relative to the door.

U.S. Pat. No. 4,345,757 to Lo Boi sets forth an anchored massage and exercising bar wherein a flexible shaft and a plurality of rollers are mounted anchored at one end at selective heights relative to a door to permit massaging of various body parts of an individual. The sections are hingedly mounted relative to one another.

As such, it may be appreciated that there continues to be a need for a new and improved exercise bar apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of exercise bar apparatus now present in the prior art, the present invention provides an exercise bar apparatus wherein the same is mounted interiorly of a door frame structure and accommodates individuals of various sized hand grips thereon. As such, the general purpose of the present invention, which will be described subsequently in greater detail, is to provide a new and improved exercise bar apparatus which has all the advantages of the prior art exercise bar apparatus and none of the disadvantages.

To attain this, the present invention provides an exercise bar rotatably mounted relative to a central support rod, the central rod including extension members extending coaxially and laterally of the bar for mounting within opposed vertical door frame portions. The bar includes an exterior shell rotatably mounted relative to an interior shell, wherein a modification of the invention includes a central rod portion of a first diameter less than that of spaced end portions to accommodate individuals of various sized hands for mounting onto the bar.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise bar apparatus which has all the advantages of the prior art exercise bar apparatus and none of the disadvantages.

It is another object of the present invention to provide a new and improved exercise bar apparatus which may be easily and efficiently manufactured and marketed.

It is a further object of the present invention to provide a new and improved exercise bar apparatus which is of a durable and reliable construction.

An even further object of the present invention is to provide a new and improved exercise bar apparatus which is susceptible of a low cost of manufacture with regard to both materials and labor, and which accordingly is then susceptible of low prices of sale to the consuming public, thereby making such exercise bar apparatus economically available to the buying public.

Still yet another object of the present invention is to provide a new and improved exercise bar apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
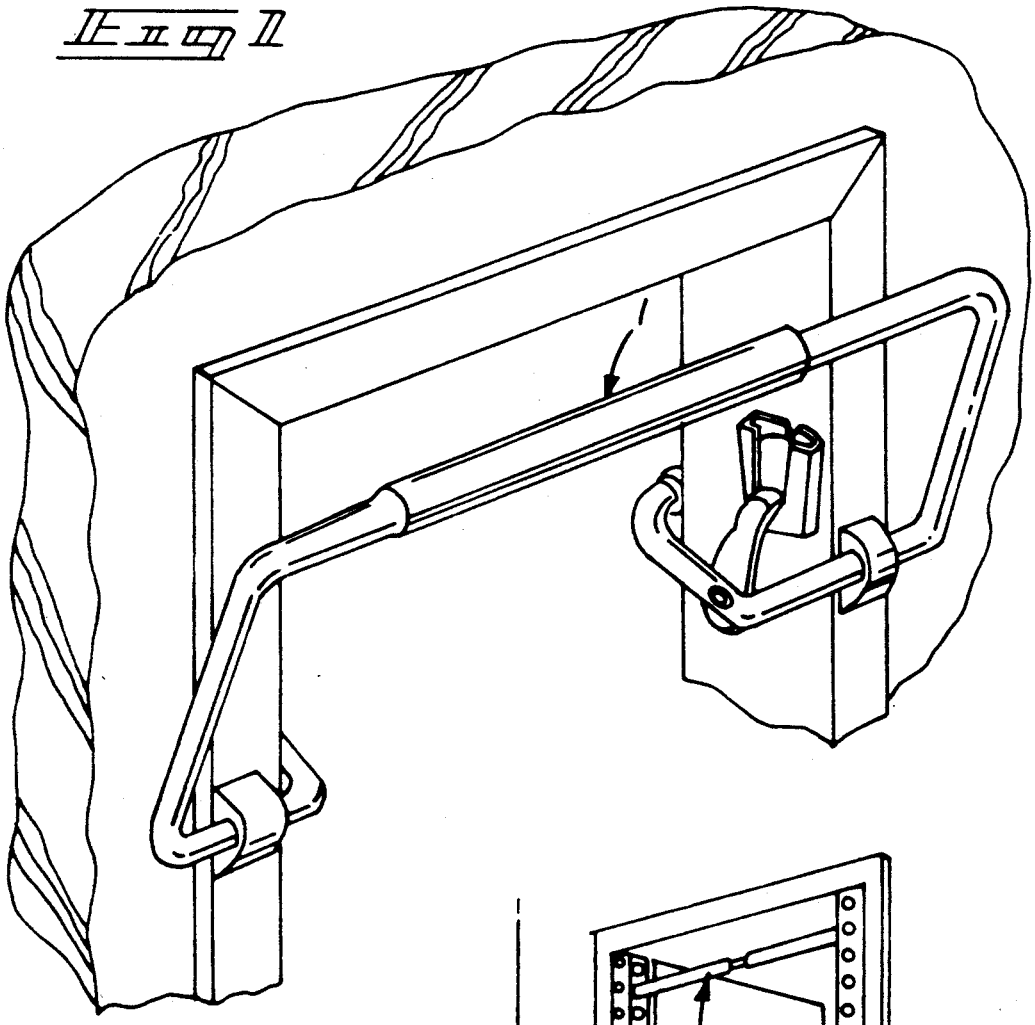
FIG. 1 is an isometric illustration of a prior art exercise bar apparatus.
Figure 2:
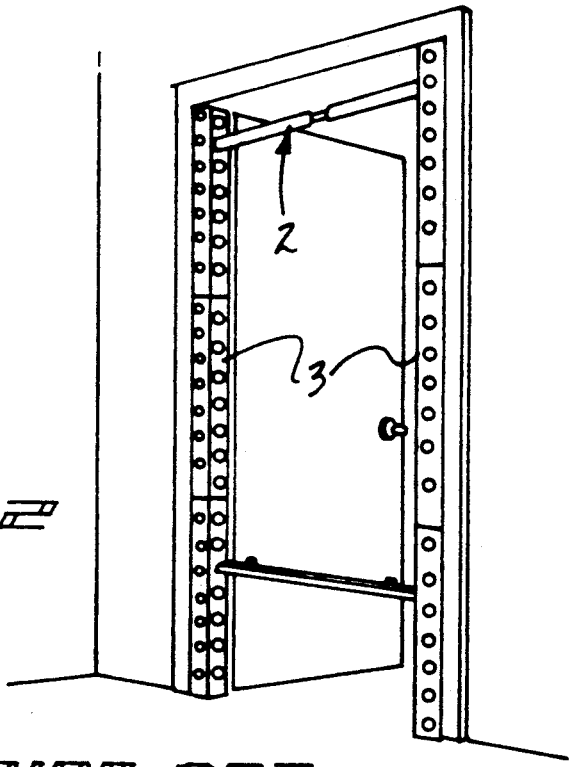
PRIOR ART FIG 2
FIG. 2 is an isometric illustration of a further example of a prior art exercise apparatus.
Figure 3:
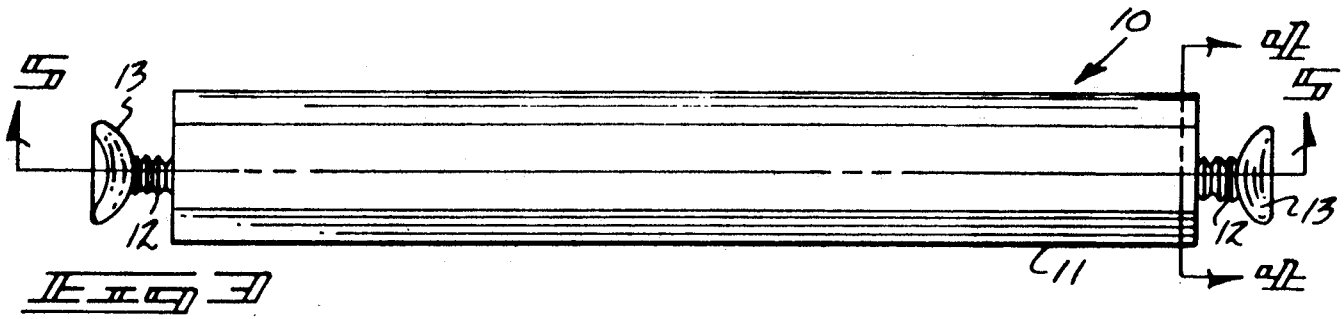
FIG. 3 is an orthographic side view, taken in elevation, of the instant invention.
Figure 4:
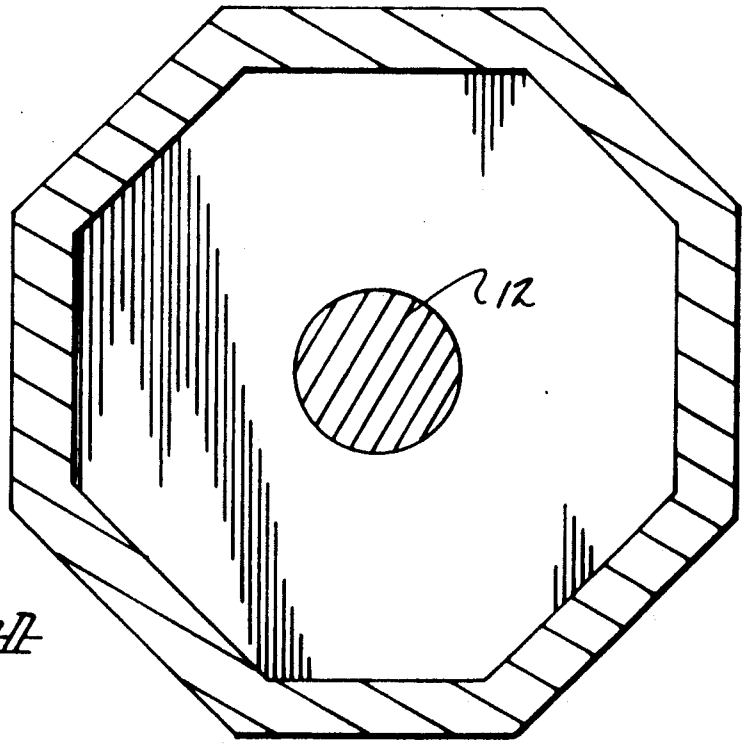
FIG. 4 is an orthographic view, taken along the lines 4—4 of FIG. 3 in the direction indicated by the arrows.

With reference now to the drawings, and in particular to FIGS. 1 to 9 thereof, a new and improved exercise bar apparatus embodying the principles and concepts of the present invention and generally designated by the reference numerals 10 and 10*a* will be described.

FIG. 1 illustrates a prior art exercise bar apparatus, as presented in U.S. Pat. No. 4,529,191, wherein the exercise bar apparatus 1 includes "U" shaped end portions to be mounted to opposed vertical planar support frames of a door utilizing bracket structure, as illustrated. U.S. Pat. No. 4,772,011 typifies the exercise bar structure 2 as set forth in FIG. 2, wherein opposed apertured posts 3 receive an exercise bar therebetween for vertical adjustment of the bar relative to the door frame structure.

Figure 5:
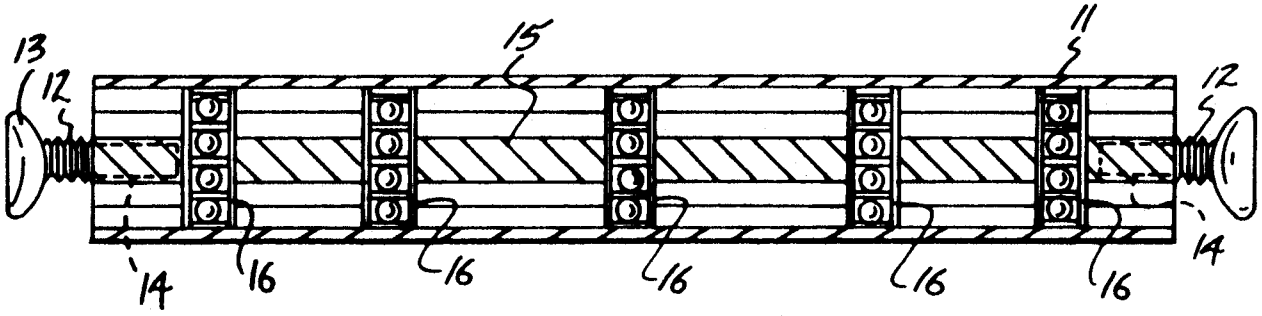
FIG. 5 is an orthographic cross-sectional illustration of the exercise bar apparatus as set forth in FIG. 3.
Figure 6:
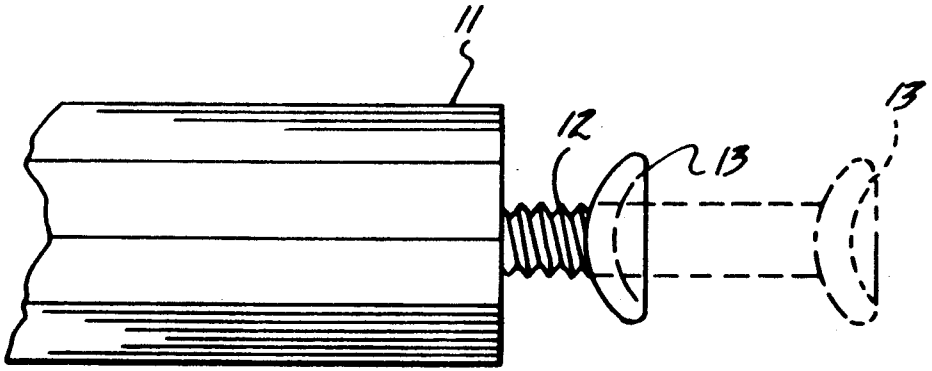
FIG. 6 is an orthographic enlarged end view of the instant invention.
Figure 8:
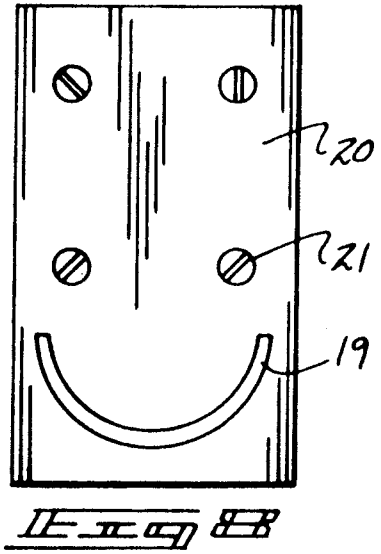
FIG. 8 is an orthographic view, taken along the lines 8—8 of FIG. 7 in the direction indicated by the arrows.

More specifically, the exercise bar apparatus 10 of the instant invention essentially comprises an elongate body 11 defined by a parallelepiped configuration formed of adjacent flats defining the polygonal external body configuration. An externally threaded adjustment rod 12 projects coaxially of and exteriorly of each end of the polygonal body 11 and includes a suction cup 13 mounted thereon. The suction cup is orthogonally aligned relative to each adjustment rod 12. An internally threaded socket 14 formed with each end of a central support rod 15 threaded receives each adjustment rod 12. The central support rod 15 is coaxially directed through the polygonal body 11, with a series of equally spaced caged bearings 16 rotatably mounting the polygonal body 11 relative to the central support rod 15, as illustrated in FIG. 5.

Figure 7:
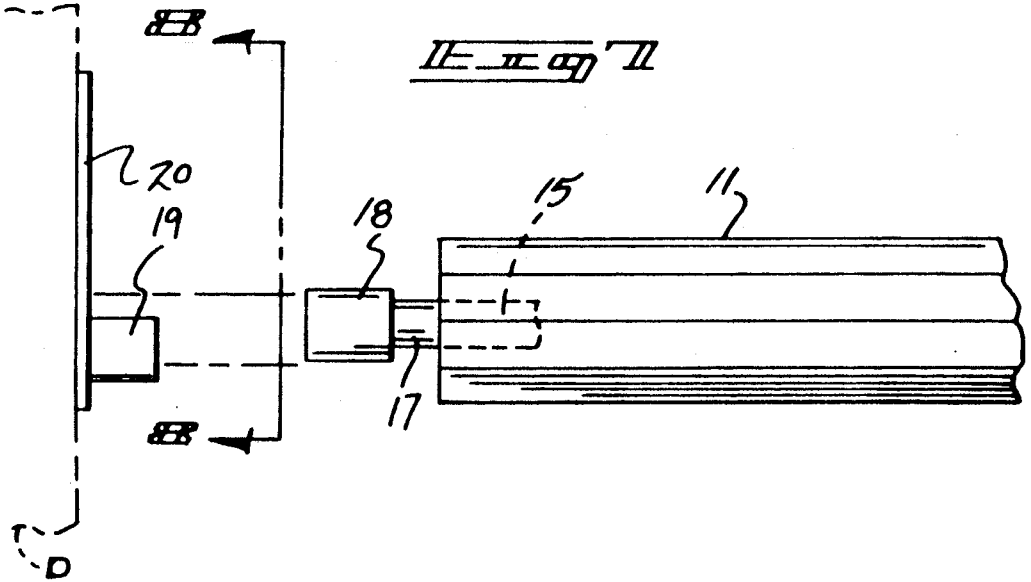
FIG. 7 is an orthographic side view of a modified securement means utilized by the instant invention.

FIG. 7 illustrates the use of the polygonal body 11, including a rod extension 17 extending coaxially of each end of the body, with a polymeric cap 18 mounted overlying each end to provide a frictional engaging surface to be received within a support cup 19. Each support cup 19 is orthogonally mounted relative to a support flange 20 for positioning within opposed sides of a door frame structure. Such door frame structure is typified in the prior art, such as in FIG. 1, by way of example. Fasteners 21 are directed through the flange 22 to accordingly mount the flange and support cup relative to the door frame structure. The rod extension 17, as in the adjustment rods 12, are threadedly received for adjustment within threaded sockets 14, as set forth in FIG. 5 for example.

Figure 9:
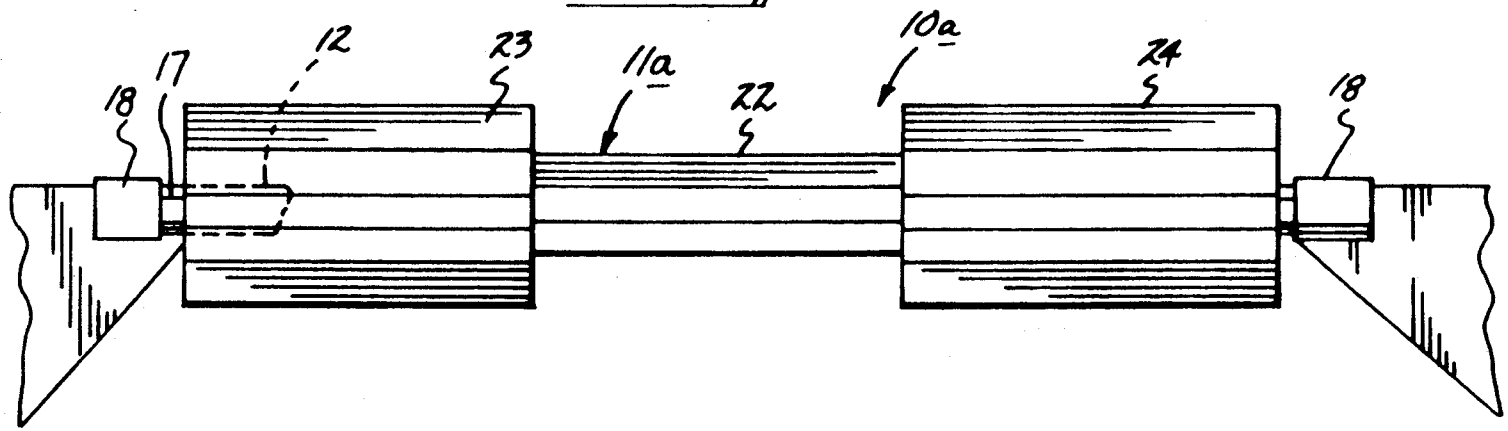
FIG. 9 is an orthographic side view of a modified exercise bar structure utilized by the instant invention.

FIG. 9 illustrates the use of a modified polygonal body, including a central polygonal body portion 22 defined by a first diameter coaxially mounting a respective first and second polygonal body external portion 23 and 24 at each terminal end of the central body 22 defined by a second diameter greater than the first diameter. The second diameter of the portions 23 and 24 accommodate individuals of enlarged hand grasping characteristics. In this manner, a larger individual may grasp the external portions for minimizing flexure of the polygonal body, wherein an individual of a reduced grasping capacity is typically accompanied by a lesser body weight for receiving the individual upon the central polygonal body 22 to accordingly provide similar flexure of the polygonal body 11*a* by individuals of either larger or reduced body weight.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An exercise bar apparatus, comprising, an elongate, coaxially aligned polygonal body defined by adjacent flats coextensive with the polygonal body, the polygonal body including a central support rod coextensively directed through the polygonal body, wherein the support rod includes an internally threaded socket formed at each terminal end of the central support rod, each internally threaded socket includes an externally threaded rod mounted thereon, and each externally threaded rod includes a polymeric cap mounted thereon, and a plurality of equally spaced caged roller bearings positioned within the polygonal body mounted between the polygonal body and the central support rod rotatably mounting the polygonal body to the central support rod, and a support cup mounted relative to each cap for receiving the cap therewithin, and each support cup is orthogonally and integrally mounted to a support flange, wherein each support flange is adapted for mounting to a vertical interior surface of a door frame, and wherein the polygonal body further includes a central polygonal body portion defined by a first diameter, the central polygonal body portion including a respective first and second polygonal body extremity portion mounted at each terminal end of the central polygonal body, wherein the first and second polygonal body extremity portions are coaxially aligned with the central polygonal body, and the central polygonal body is defined by a first diameter, the first and second polygonal body extremity portions are defined by a second diameter, wherein the second diameter is greater than the first diameter to accommodate an individual of an enlarged hand grasp for securement to the first and second polygonal body extremity portions, and wherein an individual of a reduced hand grasp is accommodated upon the central polygonal body portion.

* * * * *